United States Patent [19]

Rebne et al.

[11] Patent Number: 5,019,125

[45] Date of Patent: May 28, 1991

[54] DISPENSING CONTAINER

[75] Inventors: Thomas M. Rebne, Lenexa; David Esslinger, El Dorado, both of Kans.

[73] Assignee: Marion Merrell Dow Inc., Kansas City, Mo.

[21] Appl. No.: 545,312

[22] Filed: Jun. 26, 1990

[51] Int. Cl.[5] ..... B65D 73/02

[52] U.S. Cl. ..... 206/532; 206/531; 206/538; 206/539; 206/528; 220/345

[58] Field of Search ..... 206/528, 531, 532, 533, 206/534, 538, 539, 477, 828; 220/337, 345

[56] References Cited

U.S. PATENT DOCUMENTS

| | | | |
|---|---|---|---|
| 2,309,111 | 1/1943 | Hothersall | 220/345 |
| 2,358,194 | 9/1944 | White | 206/538 |
| 2,777,570 | 1/1957 | Mytinger | 220/345 |
| 2,935,188 | 5/1960 | Thomas | 206/42 |
| 3,199,489 | 8/1965 | Ruoss et al. | 206/531 |
| 3,276,573 | 10/1966 | Kaufman et al. | 206/531 |
| 3,324,996 | 6/1967 | Jordt | 206/531 |
| 3,351,192 | 11/1967 | La Plante | 206/56 |
| 3,504,788 | 4/1970 | Gray | 206/42 |
| 3,563,405 | 2/1971 | Zaremski | 206/539 |
| 3,759,371 | 9/1973 | Marks | 206/539 |
| 4,074,806 | 2/1978 | Ardito | 206/539 |
| 4,169,531 | 10/1979 | Wood | 206/532 |
| 4,192,422 | 3/1980 | Kotyuk | 206/528 |
| 4,231,477 | 11/1980 | De Felice | 206/532 |
| 4,298,125 | 11/1981 | Berghahn et al. | 206/531 |
| 4,333,567 | 6/1982 | Leonard | 220/345 |
| 4,384,649 | 5/1983 | Brodsky | 206/538 |
| 4,429,792 | 2/1984 | Machbitz | 206/528 |
| 4,485,915 | 12/1984 | Berghahn | 206/532 |
| 4,511,032 | 4/1985 | Bush | 206/1.5 |
| 4,574,954 | 3/1986 | Reid | 206/531 |
| 4,664,262 | 5/1987 | White | 206/531 |
| 4,838,425 | 6/1989 | O'Brien et al. | 206/531 |
| 4,911,337 | 3/1990 | Rosenthal | 220/239 |

*Primary Examiner*—David T. Fidei

*Attorney, Agent, or Firm*—Quarles & Brady

[57] ABSTRACT

A solid medicament dispensing device having a cover and tray to provide a container for a cartridge for the solid medicament. The cover has hinged panel members and the tray an opening in the floor. When the hinged panel members are moved against the cartridge, it forces the medicament out of the cartridge and through the tray opening. The dispensing device is particularly suited for dispensing large dosages of capsules.

4 Claims, 2 Drawing Sheets

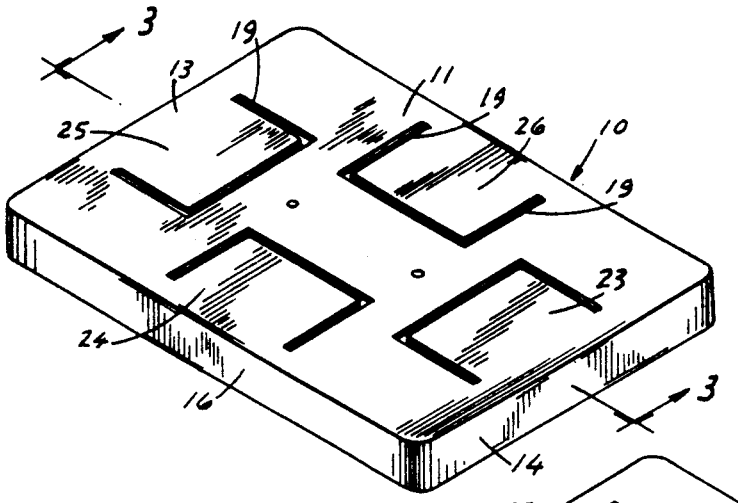
FIG. 1.
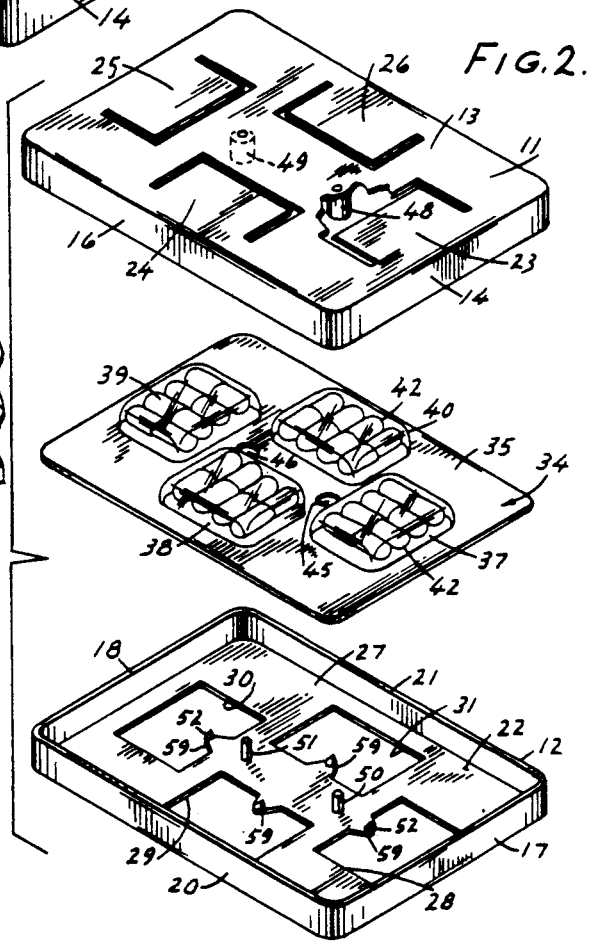
FIG. 2.
FIG. 4.
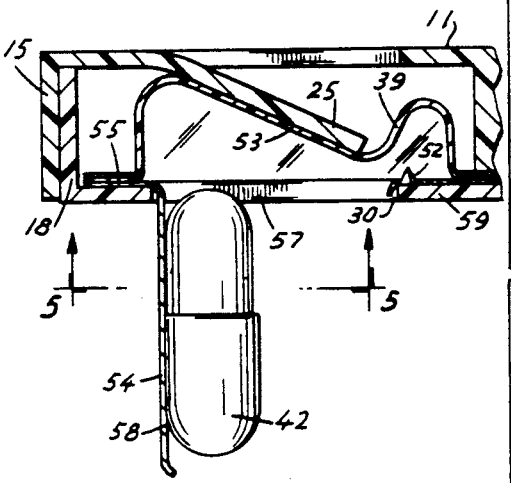
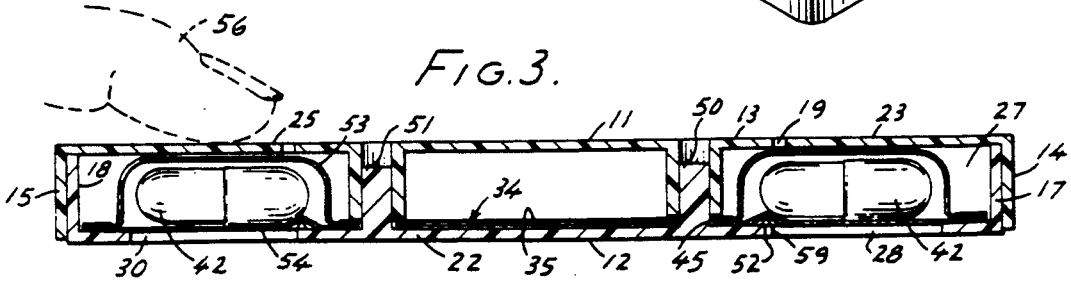
FIG. 3.

FIG. 5.
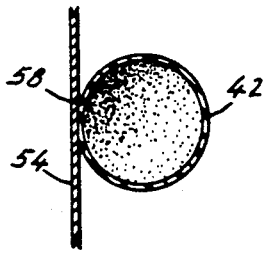
FIG. 6.
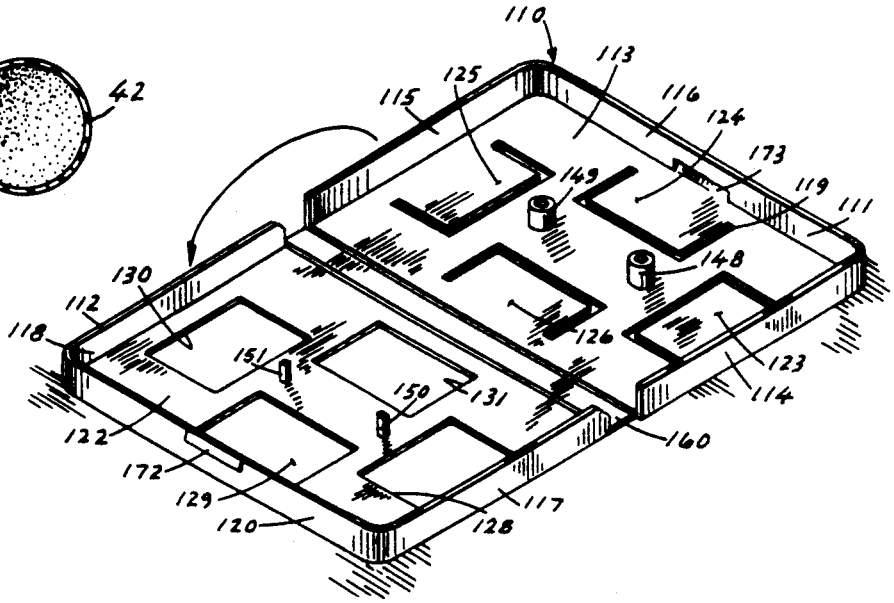
FIG. 7.
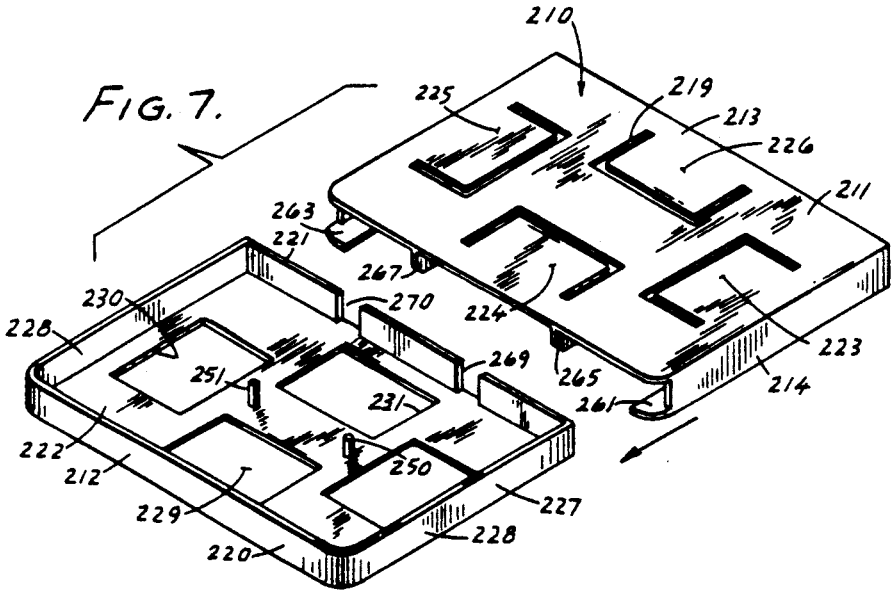
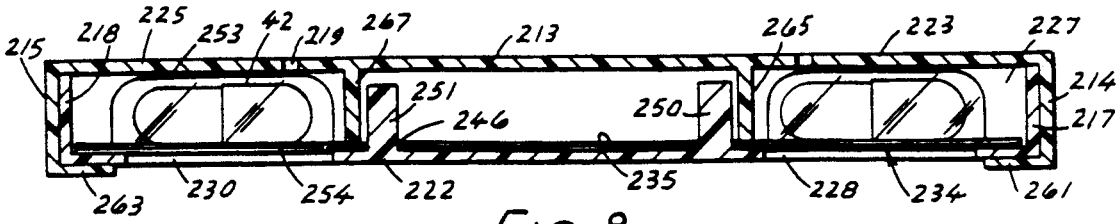
FIG. 8.

DISPENSING CONTAINER

BACKGROUND OF THE INVENTION a) Field of the Invention

This invention relates to a container for dispensing a product. More particularly it relates to compact type container wherein a medicinal product can be dispensed according to a prescribed dosage format.

b) State of the Art

The dispensing of medicinal tablets from a compact type container is well known. For example, in U.S. Pat. No. 4,169,531, a pill is pushed by finger force from a container through a thin layer of material 40. Additional types of solid medicinal dispensing devices are described in U.S. Pat. No. 4,511,032 and 4,664,262, wherein capsules and pills are delivered from a container. All of these patents are concerned with the dispensing of pill or capsule one at a time. However, there is a need in many instances to dispense one or more pills or capsules at a given time. For example, in the treatment of ulcerative colitis with Pentasa® (mesalamine) the recommended dosage ranges from 2 to 4 capsules four times daily. In this instance, it would be helpful to have a container which would accommodate a daily dosage but would dispense a single dosage of more than one pill or capsule by a single actuation of the dispensing means in the container.

It is an advantage of the present invention to provide an improved dispensing container.

It is another advantage of the present invention to provide a container which can accommodate a cartridge of pills or capsules and can dispense more than one pill or capsule by a single actuation.

It is yet another advantage of the present invention to provide a container of the foregoing type wherein the dispensing of the pills or capsules can be effected in part by the actuation of a hinged panel or contacting member forming a part of the container.

It is still another advantage of the present invention to provide a container of the foregoing type which is adaptable to a wide variety of container configurations.

SUMMARY OF THE INVENTION

The foregoing advantages are accomplished and the shortcomings of the prior art are overcome by the present solid medicament dispensing device which includes a first member and a second member constructed and arranged to provide a container cavity. An opening is provided in one of the first and second members and a hinged contacting member in the other with the opening and the hinged contacting member being in alignment. A cartridge having a compartment for the solid medicament is positioned in the container cavity in a manner to align the compartment between the opening and the hinged contacting member. The compartment is composed in part of a severable material. When the compartment is aligned in the container as previously stated and the hinged contacting member moved inwardly toward the opening, the contacting member engages the compartment and forces the medicament through the severable material and out through the opening without damaging the contents.

In one embodiment, the dispensing device includes at least one post member extending from either the first or second member and the cartridge has an opening for placement over the post to align the compartment between the opening and the hinged contacting member.

In another embodiment, the dispensing device further includes a second post member extending from the other first or second member for telescoping over the first post member to contact the cartridge to hold it in place.

In other aspects, the first and second members telescope with respect to each other; are connected by a hinge member; or, one of the members has lateral support walls for slidingly receiving the other.

In yet other aspects, the hinged contacting member is a panel member and there are piercing means to precut the severable material of the cartridge to assist in releasing the contents.

BRIEF DESCRIPTION OF THE DRAWINGS

A better understanding of the solid medicament dispensing container will be accomplished by reference to the drawings wherein:

FIG. 1 is a top perspective view of the medicament dispensing container of this invention.

FIG. 2 is an assembly view of the dispensing container shown in FIG. 1.

FIG. 3 is a view in vertical section taken along line 3—3 of FIG. 1.

FIG. 4 is a partial view in vertical section illustrating the dispensing of a capsule from the dispensing container of this invention.

FIG. 5 is a view in horizontal section taken along line 5—5 of FIG. 4.

FIG. 6 is a top perspective view showing an alternative embodiment and in an opened position.

FIG. 7 is a view similar to FIG. 6 of yet another alternative embodiment in a preassembled condition.

FIG. 8 is a view in vertical section of the container of FIG. 7 when in an assembled condition.

DESCRIPTION OF THE PREFERRED EMBODIMENTS

Proceeding to a detailed description of one embodiment of the invention, and referring specifically to FIGS. 1 and 2, the dispensing device generally 10 includes a cover member 11 for placement over a tray member 12 in a telescopic manner. The cover member 11 has a cover wall 13, end walls 14 and 15 (see FIG. 3), as well as side walls one of which is shown at 16. It is seen that there are four hinged panels 23, 24, 25 and 26 provided by the slots 19.

The tray member 12 has the end walls 17 and 18, a base wall 22 and the side walls 20 and 21. The tray member 12 has the openings 28, 29, 30 and 31. As best seen in FIGS. 2 and 3 there are four piercing spikes 52 supported adjacent the openings 28–31 by the extension portions 59. The purpose of these will be explained later. Two posts 50 and 51 extend from the base wall 22. The purpose of these posts are to fit into the openings 45 and 46 of the cartridge generally 34 when the cartridge is placed inside the cavity 27 of the tray member 12 and under the cover member 11. The cartridge 34 includes a backing 35 and four compartments 37, 38, 39 and 40. Inside each compartment are contained four capsules each designated at 42.

Referring specifically to FIG. 3, it is seen that when the cartridge 34 is placed between the tray member 12 and the cover member 11 the posts 48 and 49 which extend from the cover member 11 telescope over the posts 50 and 51 in the tray member 12. In this manner, the posts 48 and 49 engage the surface portion 35 of the cartridge so as to hold the cartridge 34 in place. The posts 50 and 51 serve the function of orientating the cartridge 34 so that the compartments 37–40 are aligned over the openings 28–31. With the cartridge 34 in the previously described orientated position with respect to the openings 28–31 they will also be aligned under the hinged panels 23–26 in the cover member 11.

Referring specifically to FIG. 4, each of the compartments such as 39 is composed of a flexible material 53 at the top and a tear away material 54 at the bottom. In this instance, the flexible material 53 is a laminate material composed of layers of polyvinyl chloride, polyethylene and saran with the saran layer placed for contact with the hinged panel as later described. The tear away material 54 is aluminum foil. The flexible material 53 and the tear away material 54 are sealed to a backing material 55 which has an opening such as 57 over which extends the tear away material 54. In order to dispense the capsules 42 from the cartridge 35, the hinged panel such as 25 is moved downwardly such as indicated in FIG. 4. This can be effected by the force of one's finger 56 as shown in FIG. 3. This causes an inward flexing of the flexible material 53 which causes the tear away material 54 to be punctured by piercing spike 52 and, in turn pushes the capsule 42 through the tear away material 54 and out through the opening 57 in the cartridge 34 as well as the opening 30 in the tray member 12. The capsule will assume a position such as shown in FIG. 4 prior to dropping into one's hand. As illustrated in FIG. 5, the aluminum foil 47 will provide an adhesive surface 58 for the capsule 42 when the capsule is in a slightly warm condition.

Referring to FIGS. 6 and 7, there are shown alternative embodiments generally 110 and 210. Similar components are referred to with similar numbers as were used in conjunction with embodiment 10 except they are numbered in the "100", "200" series. With respect to the embodiment 110 in FIG. 6, it has many of the same components as described for embodiment 10 and operates in substantially the same way. It has the posts 150 and 151 over which can be placed a cartridge such as 34 and held by the posts 148 and 149 when the cover member 111 is placed over the tray member 112. The difference between the embodiment 10 and 110 is that the cover member 111 and the tray member 112 are connected by an integral hinge member 160. Also there is provided a snap fitment closure as provided by the projection 172 and the undercut 173.

Concerning embodiment 210, this embodiment also includes many of the same components as described for embodiment 10 and operates in the same manner with respect to the dispensing of the capsules 42. It receives the cartridge 35 over the posts 250 and 251 in the tray member 212. A sliding relationship is effected between the cover member 211 and the tray member 212 by the lateral support walls 261 and 263 over which portions of the base wall 222 slide. Unlike the previous embodiments, there are no posts extending from the cover wall 213. In this embodiment these could interfere with the sliding relationship between the cover member 211 and the tray member 212 and would not telescope with the posts 250 and 251. Instead, there are two flanges 265 and 267 which slide through the openings 269 and 270 when the cover member 211 and the tray member 212 are slidably engaged. These flange members 265 and 267 contact the cartridge 35 to hold it in place. This is best seen in FIG. 8.

It will thus be seen that through the present invention there is now provided a unique container and dispensing system wherein a cartridge of capsules can be placed in a container. To dispense the capsules from the container, only the movement of a contacting member such as a hinged panel member need be moved in the direction of the capsules so as to move them out of the cartridge as well as out of the container. As seen from the embodiments herein, the container of this invention lends itself to various styles of fabrication whether of the telescoping, hinged or slidable relationship type with respect to the cover and the bottom tray member.

In the previously described embodiments, there have been shown four capsules in cartridge compartments such as 37–40. It is obvious that a compartment could contain as few as one capsule or as many as could be conveniently dispensed through an opening in a tray-like member. While certain materials have been indicated for use in fabricating the cartridge 34, it is obvious that any number of materials which can function as a flexible material for contact with the hinged contacting member as well as for use as a tear away material could be substituted for those previously designated. For example, and in a preferred manner the tear away material 54 is a laminate of aluminum foil, polyester film and paper with the paper on the outside and the foil in contact with the capsule. In this instance the backing material 55 and opening 57 would not be used and the flexible material 53 and the tear away laminate would be directly sealed together. This is what is known as a child resistant package and where the spikes serve to precut the tear away laminate. It should be further understood that in the case where the tear away material 54 is aluminum foil only, the use of the spikes 52 is optional. While in one embodiment one spike 52 has been shown adjacent each opening 28–31, alternatively a plurality of spikes or small serrations could be used with respect to each opening.

The materials for fabricating the cover and tray members 11 and 12, respectively, are styrene, polyethylene or prolypropylene with polypropylene being preferred for the embodiment 110 because of the hinge 160. Other resinous plastics could be employed as long as they afford a durable container system and permit the hinging actions of the panels such as 23–26. Capsules 42 are described as the preferred solid medicament for use with the dispensing device. Any solid medicament such as tablets or pills could be used. Further, the flanges 265 and 267 have been described in place of the posts such as 148 and 149. If desired, these flanges 265 and 267 could be replaced with grooved tracks inside the cover member 211 and the posts 250 and 251 designed to ride therein. This would give added stability.

The foregoing invention can now be practiced by those skilled in the art. Such skilled persons will know that the invention is not necessarily restricted to the particular embodiments presented herein. The scope of the invention is to be defined by the terms of the following claims as given meaning by the preceding description.

We claim:

1. A solid medicament dispensing device comprising:

a first member and a second member constructed and arranged to provide a container cavity;

at least one opening in one of said first and second members and at least one hinged contacting member in the other of said first and second members, said opening and said contacting member oppositely positioned and being in alignment;

a cartridge having a compartment for said solid medicament, said cartridge adapted to be positioned in said container cavity in a manner to align said compartment between said opening and said contacting member, said compartment composed in part of a severable material; and piercing means positioned in said one member opposite said hinged contacting member;

so that with said compartment aligned in said container as previously defined and with said contacting member moved toward said opening, said contacting member will force said severable material against said piercing means and said medicament will be released from said severable material and out through said opening.

2. The solid medicament dispensing device as defined in claim 1 wherein said solid medicament is a capsule and said severable material and capsule are composed of materials to provide a minor adhesive effect there between.

3. The solid medicament dispensing device as defined in claim 1 wherein said piercing means is a piercing spike and is positioned adjacent said opening.

4. A solid medicament dispensing device comprising:

a cover member and a base member having upstanding side walls and a floor to provide a container cavity, said cover member having support walls constructed and arranged to receive said base member in a transverse, slideable and telescoping relationship;

at least one opening in said floor of said base member and at least one hinged contacting member in said cover member, said opening in said floor and said contacting member constructed and arranged to be in alignment; and a cartridge having a compartment for said solid medicament, said cartridge adapted to be positioned in said container cavity in a manner to align said compartment between said opening and said contacting member, said compartment composed in part of a severable material, said base member having at least one opening in said side wall and said cover member having at least one flange member for passing through said opening in said side wall and for contacting said cartridge to hold said cartridge against said base member;

so that with said compartment aligned in said container as previously defined and with said contacting member moved towards said opening, said medicament would be forced through said severable material and out through said opening.

* * * * *